US006165041A

United States Patent [19]

Lin

[11] Patent Number: 6,165,041

[45] Date of Patent: Dec. 26, 2000

[54] LIQUID-TYPE ROCKING ORNAMENT

[76] Inventor: Rich Lin, 17F, No. 309, Sec. 2, Wen Hua Rd, Panchiao, Taipei Hsien, Taiwan

[21] Appl. No.: 09/408,950

[22] Filed: Sep. 30, 1999

[51] Int. Cl.[7] ..... A63H 3/52; A63H 23/08

[52] U.S. Cl. ..... 446/267; 446/325; 446/326; 446/396; 40/409

[58] Field of Search ..... 446/267, 153, 446/74, 73, 72, 71, 75, 76, 77, 396, 325, 326; 40/406, 407, 409, 411, 414; D19/95, 96; 273/457, 138.5, 161; 472/137; 473/594

[56] References Cited

U.S. PATENT DOCUMENTS

| | | | |
|---|---|---|---|
| 2,554,516 | 5/1951 | Anthony | 446/396 |
| 2,942,379 | 6/1960 | Oman et al. | 446/396 |
| 3,323,798 | 6/1967 | Miller | 446/396 |
| 4,582,498 | 4/1986 | Tamada | 446/267 |
| 5,187,889 | 2/1993 | Kraselsky et al. | 40/410 |
| 5,545,069 | 8/1996 | Glynn et al. | 446/73 |
| 5,706,594 | 1/1998 | Lin | 40/406 |

*Primary Examiner*—Sam Rimell
*Assistant Examiner*—Urszula M Cegielnik
*Attorney, Agent, or Firm*—Dougherty & Troxell

[57] ABSTRACT

A liquid-type rocking ornament includes a transparent container and a seat assembled to a bottom of the container. The transparent container has a dual-liquid and some floating decorative articles seal therein. Differently shaped recess, hole or slit may be formed on outer surface of the transparent container at suitable position for holding clips, pen or cards. The seat includes a semispherical shell and a weight fixedly connected near an inner bottom center of the shell, so that the whole liquid-type ornament could rock under a minor push without easily tumbling over. The liquid in the rocking ornament presents dynamic and interesting scenes that last for a period of time in the transparent container.

3 Claims, 4 Drawing Sheets

LIQUID-TYPE ROCKING ORNAMENT

BACKGROUND OF THE INVENTION

The present invention relates to a liquid-type ornament, and more particularly to a liquid-type rocking ornament that includes a transparent container with decorative liquid and floating articles sealed therein and a semispherical seat with a weight fixed toward an inner bottom center thereof. The weight enables the ornament to rock without easily tumbling over, and the liquid in the rocking ornament presents dynamic and changeful scenes that last for a period of time.

There are various kinds of liquid-type ornaments available in the markets, including a dual-liquid ornament that includes two different types of liquids and some articles floating on the liquids to create highly interesting decorative effect. These liquid-type ornaments may appear in different shapes to provide additional functions, such as to serve as a pen holder, a paper weight, a creamy liquid container, a soap case, a cup, etc. While these liquid-type ornaments have been widely incorporated in many articles used in our daily life, most of them are designed for positioning in a static manner. Therefore, the liquids and the floating decorative articles in the ornament are also in static state unless the whole ornament is taken up and shaken. It is therefore desirable to develop a liquid-type ornament that easily rocks to show dynamic and changeful scenes lasting for a period of time.

SUMMARY OF THE INVENTION

A primary object of the present invention is to provide a liquid-type rocking ornament that includes a transparent container having liquid and floating articles sealed therein, and a semispherical seat connected to a bottom of the transparent container. A weight is fixed toward an inner bottom center of the seat to enable the whole ornament to rock under a minor push without easily tumbling over. Meanwhile, the liquid and the floating articles in the rocking ornament create dynamic and interesting scenes that last for a period time.

Another object of the present invention is to provide a liquid-type rocking ornament that provides additional functions. The ornament includes a transparent liquid container that can be formed of differently shaped recess depending on actual needs, so that the liquid-type rocking ornament may also serve as pen holder, clip holder or card holder.

DETAILED DESCRIPTION OF THE PREFERRED EMBODIMENTS

Figure 1:
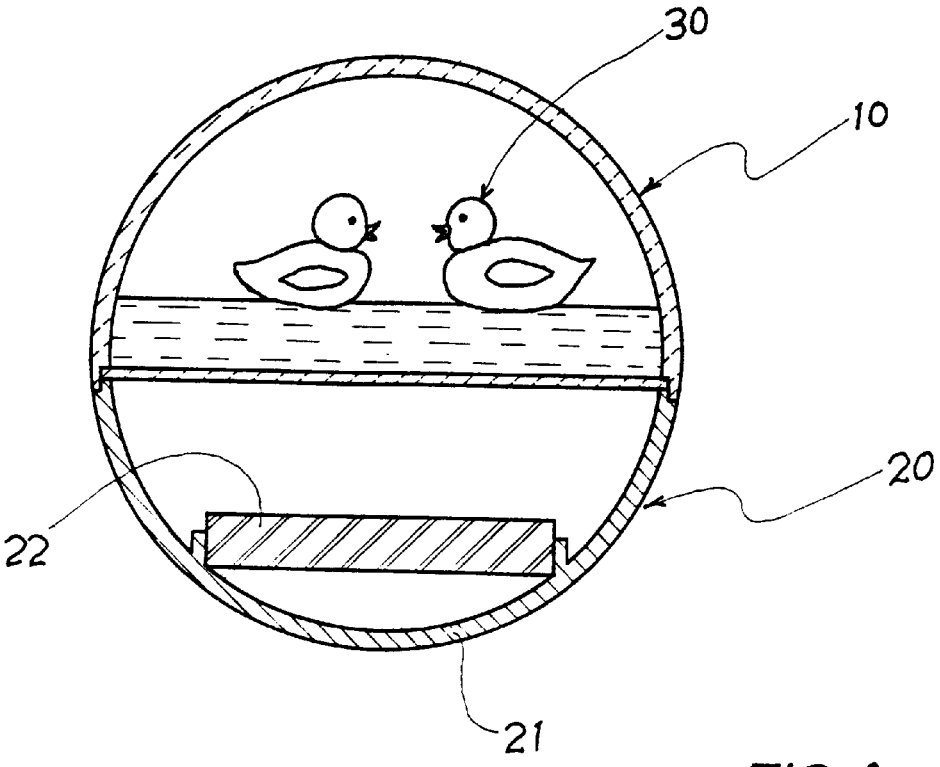
FIG. 1 is a sectional view of a liquid-type rocking ornament according to an embodiment of the present invention.
Figure 2:
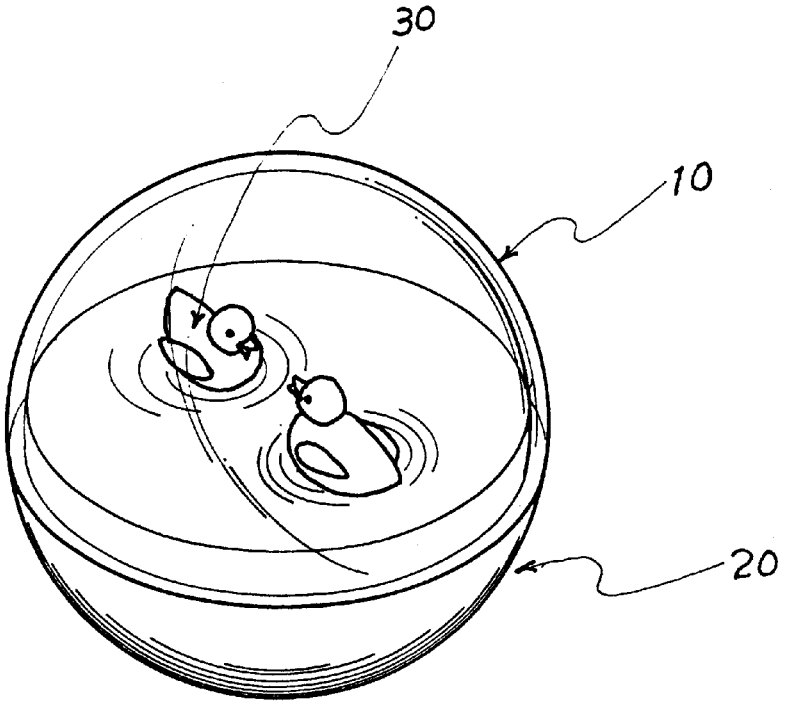
FIG. 2 is a perspective of the liquid-type rocking ornament of FIG. 1.

Please refer to FIGS. 1 and 2 that are sectional and perspective views, respectively, of a liquid-type rocking ornament according to an embodiment of the present invention. As shown, the ornament mainly includes a transparent container 10 forming an upper part of the ornament and a semispherical seat 20 forming a lower part of the ornament.

The transparent container 10 is a closed container with some kind of decorative liquid and floating articles 30 sealed therein for interestingly viewing from outside. The decorative liquid 30 shown in FIG. 1 is preferably a dual-liquid.

The seat 20 includes a semispherical shell 21 that is assembled to a bottom of the upper container 10 in any suitable manner, including tight fitting, screwing, etc. The seat 20 is provided toward an inner bottom center with a fixedly connected weight 22. The weight 22 is so weighed and positioned that it together with the semispherical shell 21 enable the whole assembly of the transparent container 10 and the seat 20, that is, the whole liquid-type ornament, to rock under aminor push without easily tumbling over. When the liquid ornament is rocking, the decorative liquid 30 in the transparent container 10 is caused to wave and the floating articles 30 move along the wavy liquid to create dynamic and changeful scenes in the container 10 for a period of time.

Figure 3:
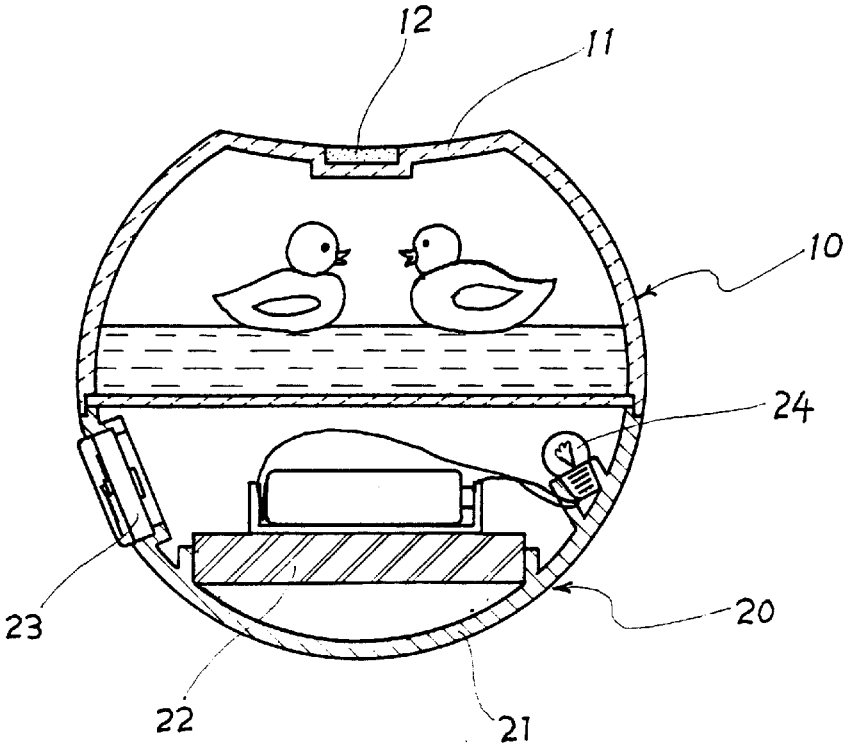
FIG. 3 is a sectional view of a liquid-type rocking ornament according to a first variant of the present invention.
Figure 4:
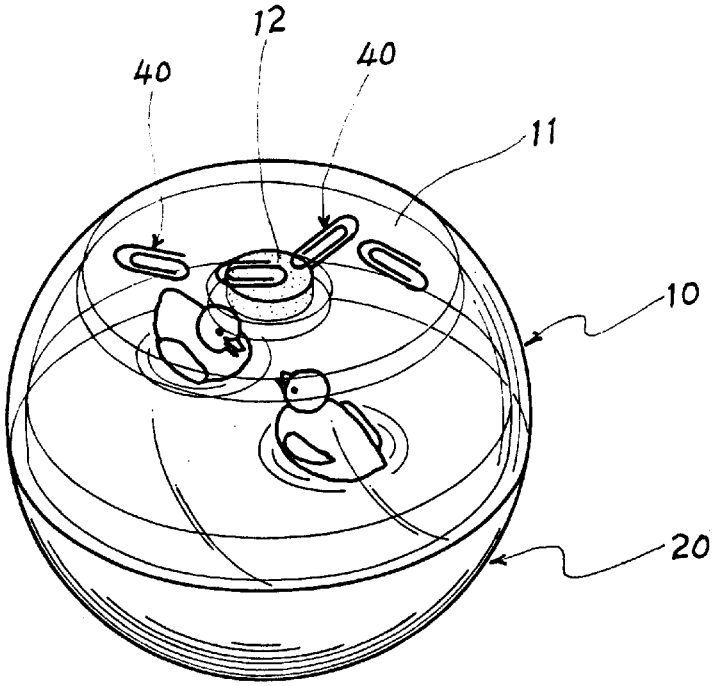
FIG. 4 is a perspective of the liquid-type rocking ornament of FIG. 3.

For the liquid-type rocking ornament of the present invention to provide additional useful functions, differently shaped recess, hole or slit 11 may be selectively provided on outer surface of the container 10. FIGS. 3 and 4 are sectional and perspective views, respectively, of a variant of the liquid-type rocking ornament of the present invention. This variant has a shallow recess 11 in the shape of a small dish formed on a top of the container 10. A small piece of magnet 12 is fixed in the recess 11. With this arrangement, the liquid-type rocking ornament may also be used to magnetically collect and hold small metal articles, such as clips.

Figure 5:
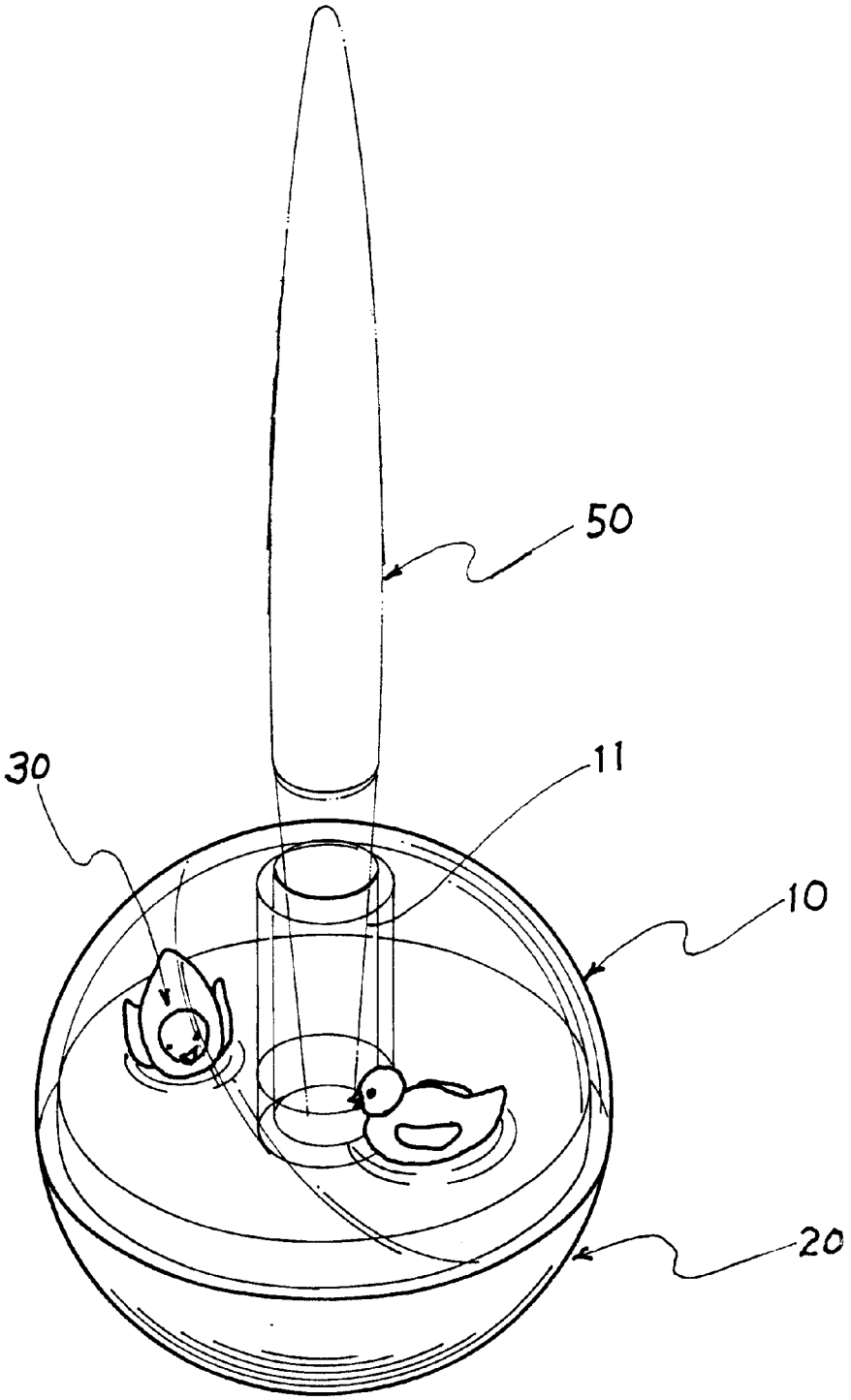
FIG. 5 is a perspective of a liquid-type rocking ornament according to a second variant of the present invention.

FIG. 5 illustrates a secondvariant of the present invention. In this variant, a vertical elongated hole 11 is centered at the transparent container 10 for a pen, for example, to conveniently position therein.

Figure 6:
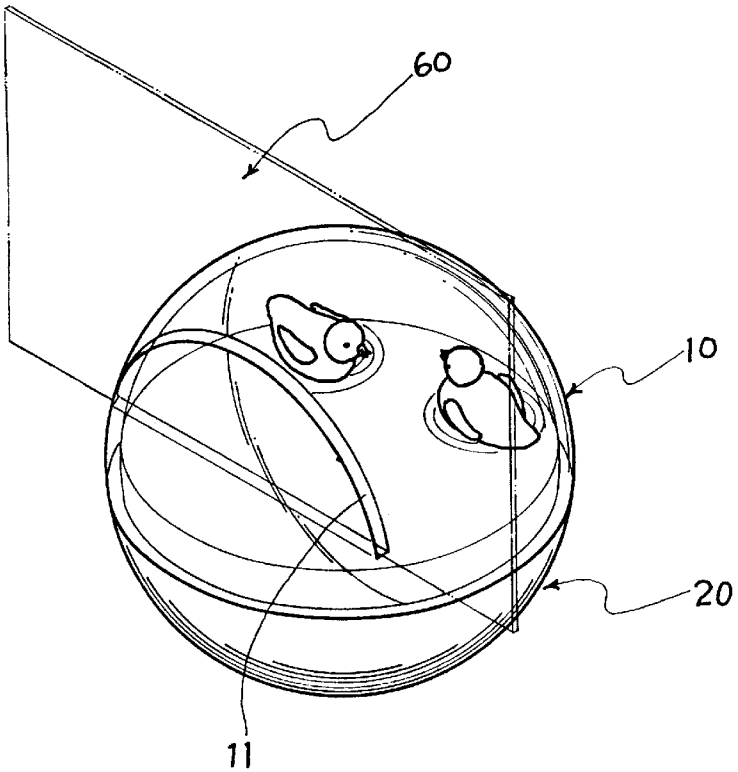
FIG. 6 is a perspective of a liquid-type rocking ornament according to a third variant of the present invention.

FIG. 6 illustrates a third variant of the present invention. In this variant, a vertical narrow slit 11 with suitable depth and length is formed on the transparent container 10 at a suitable position for cards, for example, to conveniently insert therein.

Figure 7:
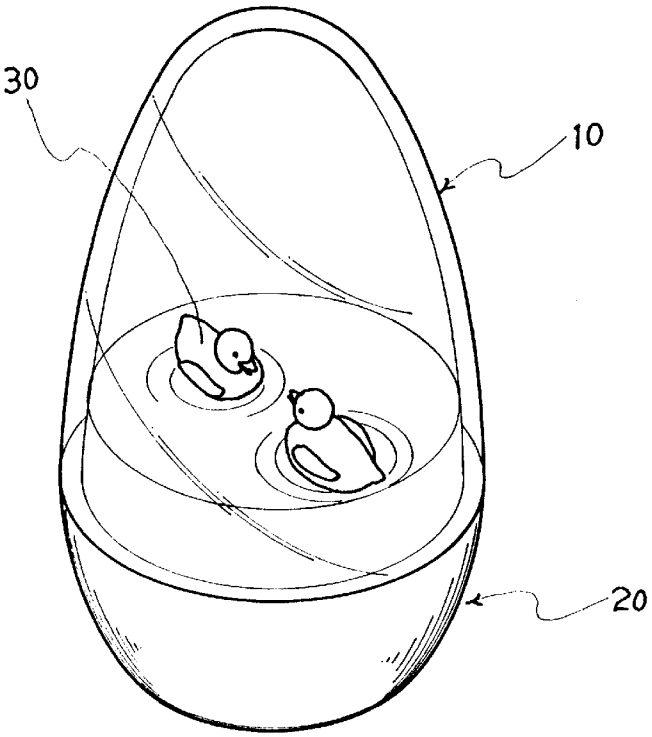
FIG. 7 is a perspective of liquid-type rocking ornament according to a fourth variant of the present invention.

Moreover, the container 10 may have different shapes, as shown in FIG. 7, so long as the assembly of these differently shaped containers 10 and the semispherical seat 20 meets necessary mechanical requirements for the whole liquid-type ornament to rock without tumbling over. The above-mentioned differently shaped recess, hole or slit 11 may also be formed on the differently shaped container 10.

Please refer back to FIG. 3. The liquid-type rocking ornament of the present invention may be further provided on or in the shell 21 of the seat 20 with other suitable and useful items, such as a clock 23 and/or a lighting means 24. The lighting means 24 may be a general bulb or a currently popular LED (light-emitting diode).

In brief, the liquid-type rocking ornament of the present invention can be easily caused to create continued, dynamic, changeful, and interesting scenes while it can be practically used as a useful desk-top article, such as pen holder, card holder or clip holder. The provision of clock and/or lighting means further diversifies the products made based on the present invention to provide more choices for consumers.

What is claimed is:

1. A liquid-type rocking ornament comprising a transparent closed container having an upper part and a semispherical seat forming a lower part of said ornament and said upper part having spherical sides and a concave top;

a decorative dual liquid and floating articles disposed within said container for viewing from the outside of said container; and said semi-spherical seat sealingly engaging said upper part and including a fixed weight in a bottom center portion thereof for positioning said ornament in an upright position and for returning the ornament to an upright position with a rocking motion when said semi-spherical base is rotated to move said weight off of bottom center and return said ornament to an upright position with a rocking motion when released whereby said decorative liquid in said transparent container is caused to move and cause said decorative liquid and floating articles to move creating a dynamic scene.

2. A liquid-type rocking ornament as called for in claim 1 which includes a magnet disposed within said concave top for holding metal clips.

3. A liquid-type rocking ornament as called for in claim 1 which includes a light emitting diode therein.

* * * * *